US008302272B2

(12) United States Patent
Dear et al.

(10) Patent No.: US 8,302,272 B2
(45) Date of Patent: Nov. 6, 2012

(54) APPARATUS FOR SWAGING A COLLAR ONTO AN EXTERNALLY GROOVED MEMBER

(75) Inventors: Aiden Robert Dear, Hitchin (GB); Angraj Kumar Seewraj, Welwyn (GB)

(73) Assignee: Avdel UK Limited, Welwyn Garden City, Hertfordshire (GB)

( * ) Notice: Subject to any disclaimer, the term of this patent is extended or adjusted under 35 U.S.C. 154(b) by 1119 days.

(21) Appl. No.: 12/160,556

(22) PCT Filed: Jan. 11, 2007

(86) PCT No.: PCT/GB2007/000063

§ 371 (c)(1),
(2), (4) Date: Aug. 14, 2008

(87) PCT Pub. No.: WO2007/091010

PCT Pub. Date: Aug. 16, 2007

(65) Prior Publication Data

US 2010/0170071 A1 Jul. 8, 2010

(30) Foreign Application Priority Data

Feb. 10, 2006 (GB) ..... 0602695.9

(51) Int. Cl.
*B23P 11/00* (2006.01)

(52) U.S. Cl. ..... 29/243.517; 29/243.5; 29/243.53; 29/243.56

(58) Field of Classification Search ..... 29/243.517, 29/243.5, 243, 56, 238, 239, 243.53, 243.529, 29/243.523

See application file for complete search history.

(56) References Cited

U.S. PATENT DOCUMENTS 3,645,125 A * 2/1972 Summerlin ..... 29/243.522

(Continued)

FOREIGN PATENT DOCUMENTS

EP 0 052 480 A1 5/1982

(Continued)

OTHER PUBLICATIONS

European Combined Search and Examination Report dated Mar. 28, 2006 which issued in connection with corresponding British Application No. GB0602695.9.

(Continued)

*Primary Examiner* — Lee D Wilson
(74) *Attorney, Agent, or Firm* — Hahn, Loeser & Parks LLP; Arland T. Stein

(57) ABSTRACT

A manually held hydraulically and pneumatically powered swaging tool for swaging a collar (35) onto a grooved or threaded bolt (36) includes jaws (39) having internal grooves (40) which match the groove (20) on the bolt. The jaws (39) are openable to receive the projecting portion of the bolt (36) and are closable to engage the bolt. An anvil (26) outside the jaws is axially movable by hydraulic means forwards over the jaws to lock them into engagement with the bolt, and then to force the anvil over the collar (35) to swage it to the bolt. The tool includes a detection rod (40) for detecting when the bolt (36) has been fully inserted into the open jaw (39). Thereby to initiate closure of the jaws by pneumatic means. Also, initial forwards movement of the anvil (26) is arranged to move the jaws axially forwards by an appropriate small distance, if this is necessary to axially align the grooves (40) on the jaws correctly in relation to the groove (20) on the bolt to enable closure of the jaws.

10 Claims, 5 Drawing Sheets

U.S. PATENT DOCUMENTS

| | | | | |
|---|---|---|---|---|
| 4,299,519 | A * | 11/1981 | Corbett | 29/243.522 |
| 4,989,442 | A * | 2/1991 | Rosier | 72/391.2 |
| 5,060,359 | A * | 10/1991 | Muir | 29/244 |
| 5,519,926 | A * | 5/1996 | Rosier | 29/243.523 |
| 6,233,802 | B1 | 5/2001 | Fulbright | |
| 2010/0170071 | A1 * | 7/2010 | Dear et al. | 29/243.517 |

FOREIGN PATENT DOCUMENTS

| | | |
|---|---|---|
| GB | 1 091 962 | 11/1967 |
| GB | 1 268 190 | 3/1972 |
| WO | 87/00891 A1 | 2/1987 |

OTHER PUBLICATIONS

PCT International Search Report and Written Opinion dated Apr. 10, 2007 which issued in connection with corresponding International Application No. PCT/GB2007/000063.

PCT International Preliminary Report on Patentability dated May 9, 2008 which issued in connection with corresponding International Application No. PCT/GB2007/000063.

* cited by examiner

APPARATUS FOR SWAGING A COLLAR ONTO AN EXTERNALLY GROOVED MEMBER

RELATED/PRIORITY APPLICATION

This application is a National Phase filing regarding International Application No. PCT/GB2007/000063, filed on Jan. 11, 2007. International Application No. PCT/GB2007/000063 relies upon British Application No. 0602695.9 (now British Patent No. 2435003), filed on Feb. 10, 2006 for priority.

BACKROUND AND SUMMARY

The invention relates to apparatus for swaging a deformable collar onto an externally grooved member. The grooves may be in the form of a thread (when the grooved member comprises a bolt or stud). Alternatively the grooves may extend circumferentially around the member (when the member comprises a lockbolt).

Such a member is hereinafter referred to as "an externally grooved member of the type defined".

The invention provides, in one of its aspects, an apparatus for swaging a collar onto an externally grooved member having grooves in the form of a thread or grooves which extend circumferentially around the member, which apparatus comprises: jaw means which are openable to receive the projecting end portion of such a grooved member on to which a collar has been placed, the jaw means being internally grooved and being closable so as to engage the grooved member; swaging means radially outside the jaw means and axially movable with respect thereto, whereby when the jaw means is closed and engages the grooved member, and an appropriate axial force is applied to the swaging means with respect to the jaw means, the swaging means is forced forwardly over the collar to swage the collar into engagement with the grooves of the grooved member; and automatic axial position adjustment means for automatically making minor axial adjustment of the position of the jaw means, if necessary, to correctly align the grooves of the jaw means with the grooves on the grooved member, thereby to enable closure of the jaw means to engage the grooved member.

An embodiment of the invention will now be described by way of example. This is a hydraulically-powered hand-held tool for swaging a collar onto a lockbolt. In the accompanying drawings:

DETAILED DESCRIPTION OF THE DRAWINGS

In these drawings, some parts of the tool which are common in the art, and are not directly parts of the present invention, are not shown.

Figure 1:
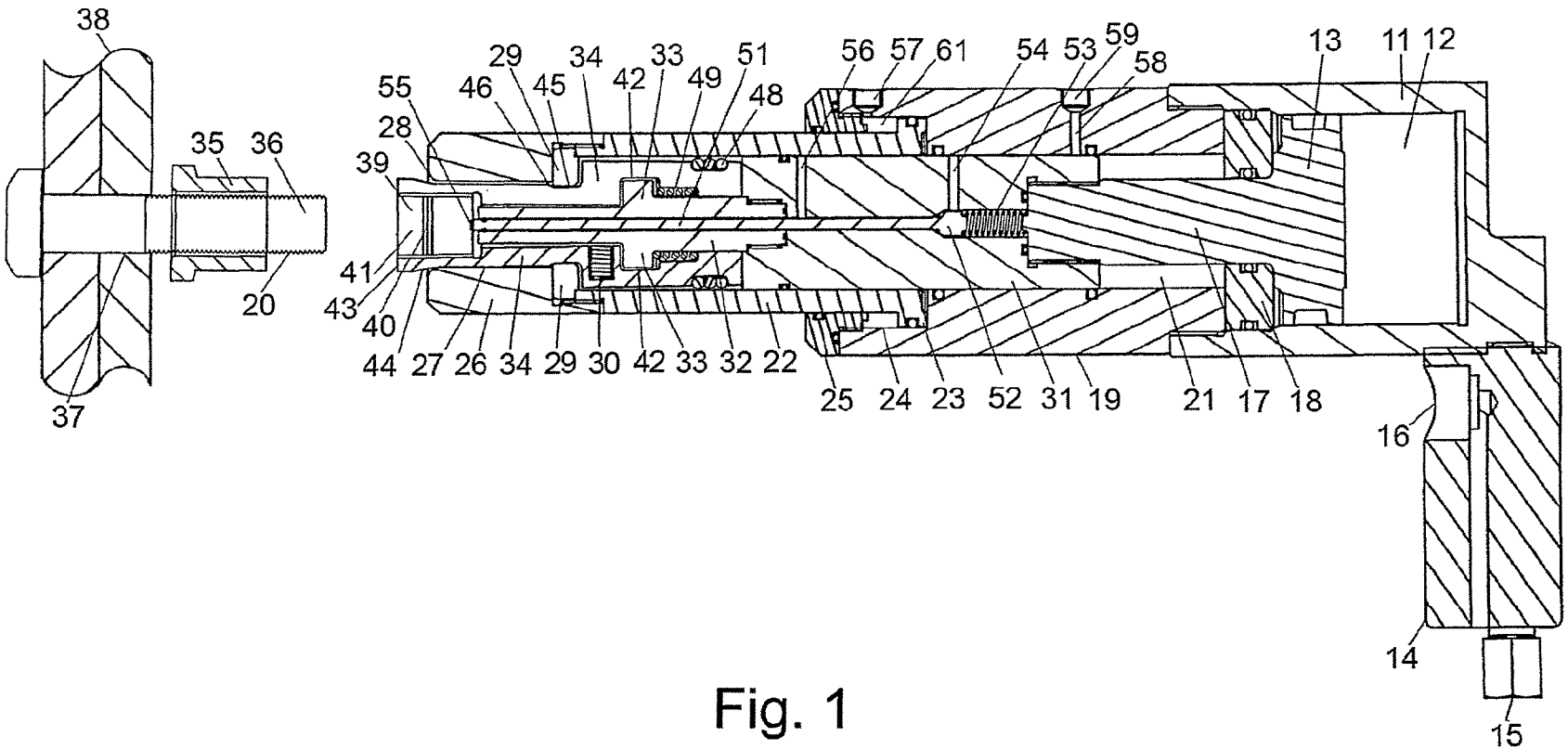
FIG. 1 is a longitudinal axial section through the tool, showing its mechanism in the rest position (i.e. unactuated)
Figure 2:
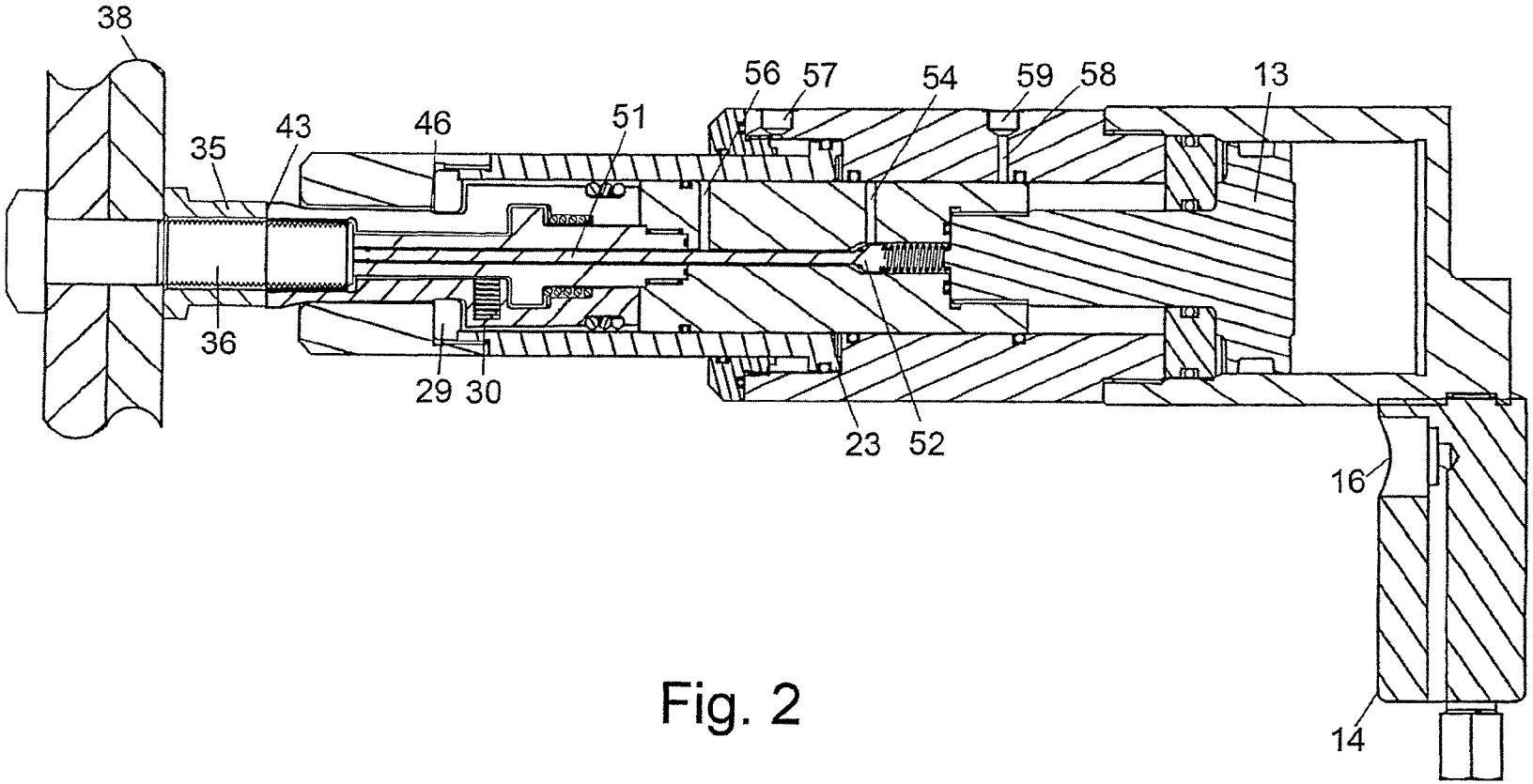
FIGS. 2, 3 and 4 are similar to FIG. 1 and show the mechanism in successive stages of operation.
Figure 5:
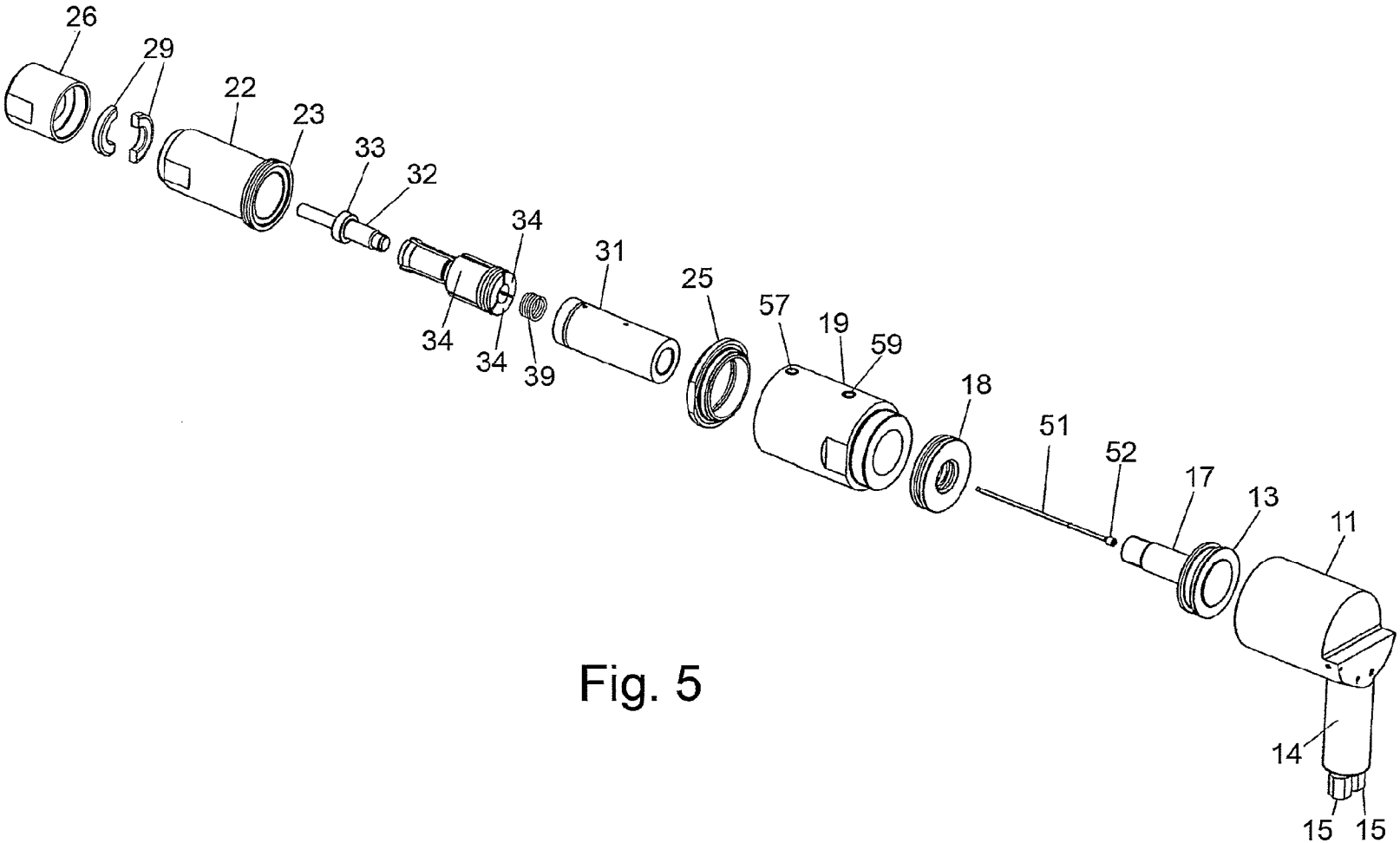
FIG. 5 is a perspective view of the parts of the tool axially exploded, by way of illustration.

Referring first to FIGS. 1 and 5, the tool of this example includes a hydraulic cylinder casing 11 defining a hydraulic cylinder 12 within which reciprocates a double-acting hydraulic piston 13. To the rear end (i.e. the right hand end as shown in the Figures) of the underside of the cylinder casing

12 is attached a handle 14. This handle carries two hydraulic line connectors 15,15 to which hydraulic hoses (not shown) are connected. By means of passages (not shown) in the handle 14 and casing 11, one of the connectors 15 feeds hydraulic fluid to and from one side of the piston 13 under the control of a trigger 16, and the other connector 15 similarly feeds hydraulic fluid to and from the opposite side of the piston 13. The handle 14 carries the trigger 16. The trigger is biassed into its outer or released position, in which it feeds hydraulic fluid under pressure to the rear of the piston 13. When the trigger is pressed against its biassing, it changes the feed of hydraulic fluid under pressure to the front of the piston 13.

The rod 17 of the piston 13 extends forwardly through the front plate 18 of the cylinder 11. To the forwards end (i.e. to the left as shown in the Figures) of the hydraulic cylinder 11 is threadedly attached a body 19 containing a cylindrical internal bore 21. At the front end of the body 19 is mounted a nosepiece tube 22, which can reciprocate to a limited extent with respect to the body 19. Thus the rear of the tube 22 has a radially extending flange 23 received within an enlargement 24 at the front of the body bore 21. The front end of the enlarged bore 24 is covered by a threadedly-engaged cap 25, through which the nosepiece tube 22 protrudes. As shown in FIG. 1, the axial length of the bore enlargement 24 is greater than the thickness of the nosepiece flange 23, thus allowing the nosepiece tube 22 to reciprocate axially to a limited extent. The forward end of the tube 22 carries an anvil 26 which is of annular form and made from hardened steel. The front end of the anvil bore 27 is formed with a chamfer or taper 28, which is of appropriate size and shape to swage over the end of a bolt collar 35. The rear end of the anvil tube 26 is threadedly attached to the front end of the nosepiece tube 22. Between the two is an annular cam plate 29. The cam plate 29 comprises two semi-circular halves, to enable the cam to be inserted into the appropriate place when the tool is assembled.

To the front end of the piston rod 17 is threadedly attached a piston tube 31, which extends forwardly through the body bore 21 and the nosepiece tube 22. The piston tube 31 has a slight radial clearance with respect to the body bore 21 and the interior of the nosepiece tube 22 (this may not be apparent from the drawings), sufficient to enable compressed air to flow along it for the purposes which will be described below. To the front end of the piston tube 31 is threadedly attached a jaw-support tube 32, which has an outwardly extending flange 33 about halfway along its length. Radially outside the jaw support tube 32 and radially inside the front end part of the nosepiece tube 22 are a set of jaws comprising three jaw members 34, 34, 34. Each jaw member has a cross-section of a 120 degrees angled sector, so that the three jaw members fit together to form an elongated generally cylindrical shaped set of jaws. Each jaw member 34 has a recess 42 which receives, with some clearance, the appropriate part of the flange 33. The jaw members are urged rearwardly with respect to the support tube 32 by means of a helical spring 49.

This tool is designed to swage a deformable collar 35 onto an externally grooved member of the type defined which is in the form of a bolt 36 with grooves 20, which is inserted through an aperture 37 in a workpiece 38. Accordingly the front portion of each jaw member 34 has an internal enlargement recess 39, the three recesses together providing a substantially cylindrical socket 41 to receive the end portion of the bolt 36. Each recess face is formed with grooves 40 (only a few of which are shown in FIG. 1 for clarity of illustration) which are complementary in shape to the grooves 20 on the bolt 36 so as to be able to engage with them. The part of each jaw member 34 between its flange 33 and its recess 39 is of slightly larger diameter than the exterior of the support tube 32 over which it is positioned, so that each jaw member can rock slightly about the flange 33, so as to open the jaws by moving slightly radially apart from each other the recesses 39 to allow the end of the bolt to enter the jaws. The jaws can then be closed to engage the bolt by the interengagement of the grooves on the jaws 34 with the grooves on the bolt 36. The jaws are normally held open by a radially contracting spring 48 around the rear ends of the jaw members and radial compression springs 30 in front of the flanges 33S.

The forward ends of the jaw members, around the recess 39, are radially thickened. This thickening has a front face 43 to contact the end face of the bolt collar 35, and a tapered rear slope 44 which co-operates with the chamfer 28 at the front end of the anvil bore. Further back each jaw member has an external recess 45 which accommodates the radially innermost part of the cam plate 29. The forward end of this recess has a rearwards-facing chamfer 46 which co-operates with the inner front edge of the cam plate 29. The recess 45 is slightly longer than the thickness of the cam plate 29, and has a rear face which can engage the rear face of the cam plate 29, there thus being a small amount of axial lost motion between the cam plate 29 and the jaw members 34.

Means for detecting when a bolt 36 has fully entered into the jaws recess 39 includes an elongated detector rod 51 positioned axially within the piston tube 31. The rear end of the detector rod has an enlarged head 52, against which presses a helical spring 53. This urges the detector rod forwards with respect to the piston tube 31, so that its head 52 seals the inner end of a radial bore 54 in the piston tube located towards its rear end. In this position the front end portion 55 of the detector rod projects slightly into the jaw recess 39, as shown in FIG. 1. There is sufficient radial clearance between the detector rod 51 and the piston tube 31 to allow compressed air to flow along this clearance as far as another radial bore 56 further forwards along the piston tube, which connects this clearance with the radial clearance between the piston tube 31 and the nosepiece tube 22. This clearance connects to the rear side of the nosepiece flange 23 (i.e. the space 62 indicated in FIG. 3). An external air pressure feed hose (not shown) is connected via connector 57 with the space 61 in the bore enlargement 24 in front of the nosepiece flange 23. Another radial bore 58 through the tool body 19 connects the clearance between the bore 21 and the piston tube 31 with a second external air hose (not shown) via a connector 59. Various O-ring seals are provided at appropriate positions along the body bore 21, as shown in FIG. 1, to seal the ends of the clearance to prevent the escape of pressure air, and to prevent the passage of air along the clearance between the radial bores 56 and 58. Thus air under pressure supplied through the connector 59 will be shut off from the rear of the nosepiece flange 23 when the air valve means provided by the detector rod head 52 is closed, i.e. when the detector rod 51 is in its forwards position, as shown in FIG. 1.

The way in which the tool operates will now be described with reference to FIGS. 1 to 4.

When the tool is in the rest position as illustrated in FIG. 1, with the trigger 16 not depressed, hydraulic pressure is fed to the rear of the piston 13 so that the piston is held in its forwards position, and the jaws 34, 34, 34 are in their open position. Since there is no bolt within the jaw recess 39, the detector rod 51 is in its forwards position so that the valve means provided by its head 52 is closed. This prevents air pressure from being supplied by the rearward air hose 59 from reaching the rear of the nosepiece flange 23.

The operator, holding the tool in his hand by means of its handle 14, offers up the tool to the projecting end of the bolt 36 so that the latter enters the jaw socket 41. He pushes the tool forwards so that the jaw front face 43 contacts the front end face of the collar 35 and pushes the collar along the bolt until the other end of the collar contacts the front face of the workpiece 38. The bolt in the workpiece has been selected so that, when this occurs, the front end of the bolt will have contacted the front end 55 of the detector rod 51 and will have pushed the rod sufficiently far backwards to unseal the inner end of the radial bore 58. This is the position illustrated in FIG. 2. The front end of the bolt is very close to, or in contact with, the front end of the jaw support tube 32.

Figure 3:
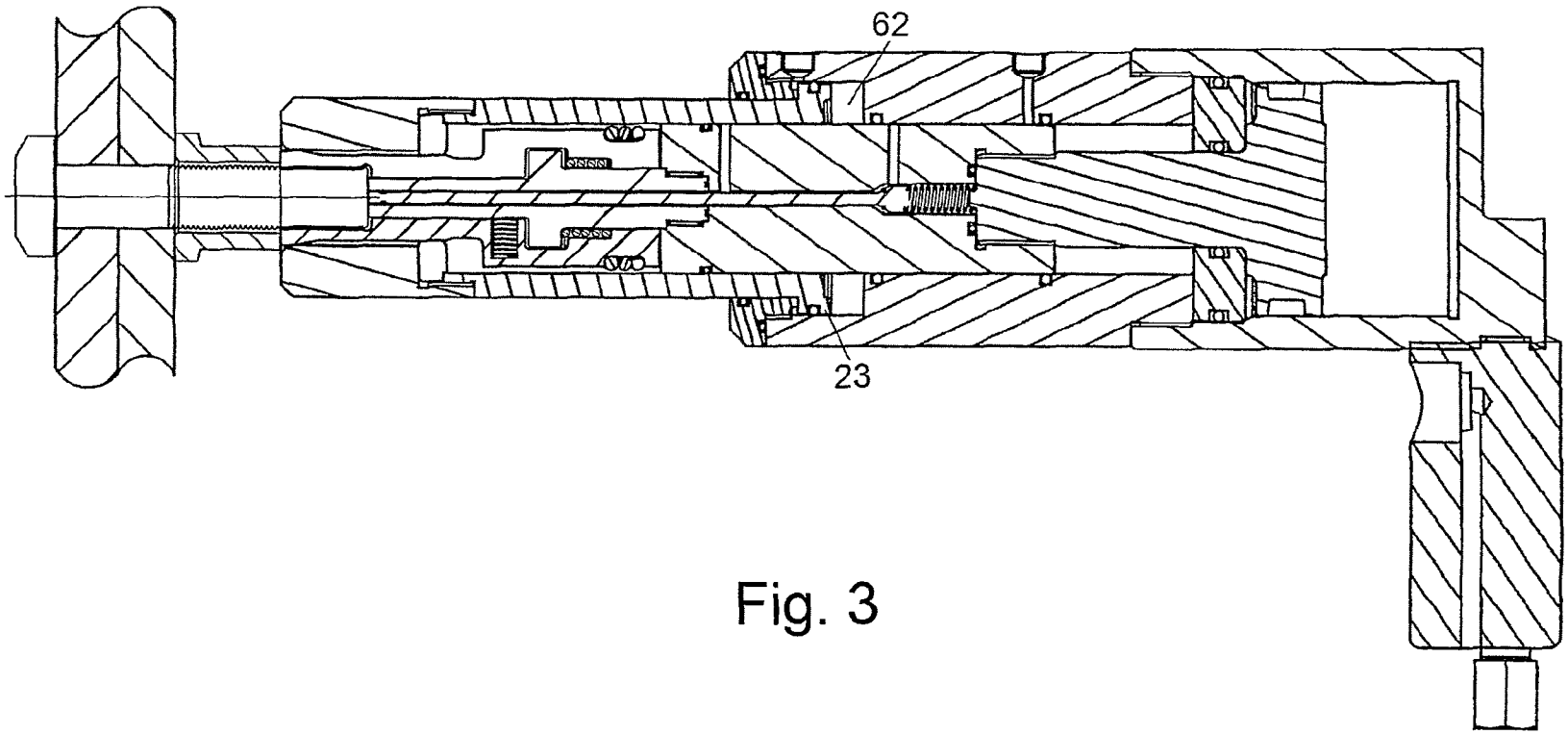

As previously described, this allows compressed air to be fed to the rear of the nosepiece flange 23. Since the area of the rear face of the nosepiece flange 23 is substantially greater than the area of its front face, the forwards force due to the air pressure on its rear face is substantially greater than the rearwards force on its front face, and the nosepiece tube 22 moves forwards, until the front face of its flange contacts the cap 25, as illustrated in FIG. 3.

As the nosepiece tube 22 and the anvil 26 move forwards with respect to the jaws (the operator is still pushing the tool towards the bolt), the jaw members 34 are urged to close together by two successive thrusts.

Firstly, the inner front edge part of the cam plate 29 engages the rearwards-facing chamfer 46 of the recess 45 on the jaw members. This urges the jaws to close together. If the grooves on the jaw recesses 39 are not accurately aligned with those on the bolt 36 (that is to say, if the crests of the grooves on the jaws are not aligned axially of the bolt with the valleys of the grooves on the bolt so that the former can immediately enter the latter), so that the jaws cannot close onto the bolt, the axial force applied by the cam plate 29 to the jaw members 34 increases. This pushes the jaw members along the bolt by a small distance sufficient to align the crests of one set of grooves with the valleys of the other set of grooves, so that the jaws can close together to engage the bolt by interengagement of the two sets of grooves.

If the grooves on the jaws are aligned with those on the bolt, the initial engagement between the cam plate 29 and the chamfer 46 on the jaws urges the jaws radially inwardly, without any adjustment of their axial position, to engage the bolt.

Secondly, the anvil bore chamfer 28 engages the rear slopes 44 on the front exterior of the jaw members. This locks the jaw members together, in the position in which they are locked onto the grooves in the bolt 36, as illustrated in FIG. 3.

Figure 4:
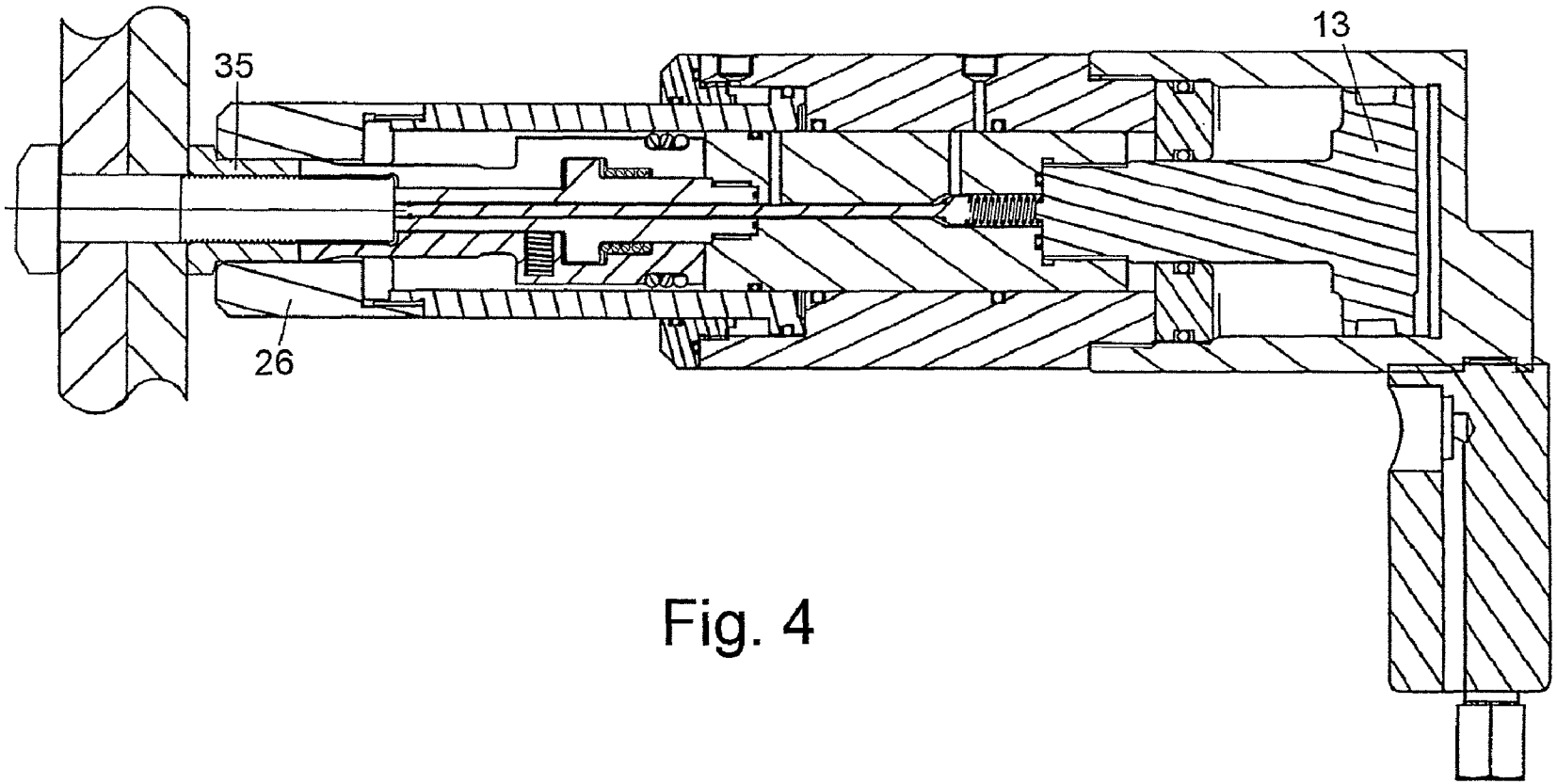

The operator now presses the tool trigger 16. This applies hydraulic fluid pressure to the front of the piston 13 and removes hydraulic pressure from its rear. This applies an increasing high force to the anvil 26, which is sufficient to overcome the forwards pneumatic force on the nosepiece flange 23, so that the tool body 19 moves forwards until the rear end of its bore 24 contacts the rear face of the flange 23. The reaction to the force on the anvil is supported by the bolt 36, and the anvil moves axially over the collar and swages it to the bolt. The anvil locks the jaws together against the radially outwards force on them from the collar as it is compressed by the anvil. The fully swaged position is shown in FIG. 4.

The operator now releases the trigger 16, so that hydraulic fluid pressure is switched back to the rear face of the hydraulic piston 13, and the anvil is thereby retracted back along the jaws, thereby releasing them from the swaged collar.

The invention is not restricted to the details of the foregoing example.

The invention claimed is:

1. Apparatus for swaging a collar onto an externally grooved member having grooves in the form of a thread or grooves which extend circumferentially around the member, which apparatus comprises:

jaw means which are openable to receive the projecting end portion of such a grooved member on to which a collar has been placed, the jaw means being internally grooved and being closable so as to engage the grooved member;

a trigger, swaging means radially outside the jaw means and axially movable with respect thereto, whereby when the jaw means is closed and engages the grooved member, and when the trigger is pressed thereby applying an appropriate axial force to the swaging means with respect to the jaw means, the swaging means is forced forwardly over the collar to swage the collar into engagement with the grooves of the grooved member; and automatic axial position adjustment means for automatically making minor axial adjustment of the position of the jaw means, after the grooved member has entered the jaw means and prior to pressing of the trigger, to correctly align the grooves of the jaw means with the grooves on the grooved member, thereby to enable closure of the jaw means to engage the grooved member.

2. Apparatus as claimed in claim 1, in which the automatic position adjustment means is provided by radially outward projections on the jaw means and radially inward projections on the axially movable swaging means, such that if the two sets of grooves are misaligned with each other so that, when the swaging means advances along the jaw means, the jaw means is prevented from engaging with the grooved member, the radially inward projections on the swaging means engage the radially outward projections on the jaw means and thereby push the jaw means axially forwards with respect to the grooved member, thereby to correctly align the two sets of grooves as aforesaid.

3. Apparatus as claimed in claim 1, which apparatus also comprises detection means for detecting when the grooved member is fully entered into the open jaw means and thence initiating closure of the jaw means to engage the grooved member as aforesaid.

4. Apparatus as claimed in claim 3, in which the detection means comprises an air valve.

5. Apparatus as claimed in claim 4, in which the air valve is biased closed and is opened by the presence of the grooved member fully entered into the jaw means.

6. Apparatus as claimed in claim 4, in which the jaw means is biased into the open position, and is closed by the application of air pressure admitted by the opening of the air valve.

7. Apparatus as claimed in claim 6, in which the jaw means is biased into the open position by resilient means.

8. Apparatus as claimed in claim 7, in which the resilient means comprises an O-ring.

9. Apparatus as claimed in claim 7, in which the resilient means comprises a spring.

10. Apparatus as claimed in claim 7, in which the resilient means comprises an O-ring and a spring.

* * * * *